US010828686B2

(12) United States Patent
Ochiai

(10) Patent No.: US 10,828,686 B2
(45) Date of Patent: Nov. 10, 2020

(54) METHOD FOR MANUFACTURING CYLINDRICAL BODY HAVING DIFFERENT DIAMETERS BY COLD FORGING

(71) Applicant: NGK SPARK PLUG CO., LTD., Aichi (JP)

(72) Inventor: Satoru Ochiai, Nagakute (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 245 days.

(21) Appl. No.: 15/778,329

(22) PCT Filed: Oct. 12, 2016

(86) PCT No.: PCT/JP2016/004549
§ 371 (c)(1),
(2) Date: May 23, 2018

(87) PCT Pub. No.: WO2017/090224
PCT Pub. Date: Jun. 1, 2017

(65) Prior Publication Data

US 2018/0345347 A1 Dec. 6, 2018

(30) Foreign Application Priority Data

Nov. 24, 2015 (JP) ..... 2015-228934

(51) Int. Cl.
*B21J 5/10* (2006.01)
*B21D 22/26* (2006.01)
(Continued)

(52) U.S. Cl.
CPC ..... *B21D 22/26* (2013.01); *B21J 5/06* (2013.01); *B21J 5/10* (2013.01); *B21J 13/02* (2013.01); *B21K 21/08* (2013.01)

(58) Field of Classification Search
CPC ..... B21J 5/02; B21J 5/10; B21J 9/04; B21J 13/02; B21K 21/08; B21D 22/26; B21D 5/06
See application file for complete search history.

(56) References Cited

U.S. PATENT DOCUMENTS 3,186,209 A * 6/1965 Friedman ..... B21K 21/08 72/334
4,882,925 A * 11/1989 Ichie ..... B21K 21/08 72/356
(Continued)

FOREIGN PATENT DOCUMENTS

JP 2002-011543 A 1/2002
JP 2007-278806 A 10/2007
(Continued)

OTHER PUBLICATIONS

Korean Intellectual Property Office, Office Action (Notificationof Reason for Refusal) issued in corresponding Application No. 10-2018-7014330, dated Jun. 3, 2019.
(Continued)

*Primary Examiner* — Edward T Tolan
(74) *Attorney, Agent, or Firm* — Stites & Harbison, PLLC; Jeffrey A. Haeberlin; James R. Hayne

(57) ABSTRACT

A multi-diameter tubular body is cold-forged by forming a large-diameter hole portion in a formed body having a preliminary hole through subjection of the preliminary hole to deep hole forming and by punching out the bottom surface of the large-diameter hole portion to thereby form a small-diameter hole portion. Since a punch having a central protrusion on its forward end surface is used, an internal flaw is generated by dead metal in the inner circumferential surface of a depression, formed by the protrusion, in the bottom surface of the large-diameter hole portion. An outside diameter of a protrusion of a deep hole forming punch
(Continued)

is rendered smaller than an inside diameter of the small-diameter hole portion to be formed later by punching out the bottom surface of the large-diameter hole portion. As a result, the internal flaw is removed when the small-diameter hole portion is formed.

4 Claims, 9 Drawing Sheets

(51) Int. Cl.

| | |
|---|---|
| ***B21J 5/06*** | (2006.01) |
| ***B21J 13/02*** | (2006.01) |
| ***B21K 21/08*** | (2006.01) |

(56) References Cited

U.S. PATENT DOCUMENTS

| | | | | |
|---|---|---|---|---|
| 5,186,082 | A * | 2/1993 | Kuramitsu | B21J 5/12 72/353.4 |
| 6,357,274 | B1 * | 3/2002 | Tanaka | B21C 23/20 72/355.6 |
| 7,013,696 | B2 * | 3/2006 | Ando | B21C 23/20 72/355.6 |
| 8,322,184 | B2 * | 12/2012 | Kariya | B21K 1/28 72/355.6 |
| 9,643,238 | B2 * | 5/2017 | Ochiai | B21K 21/08 |
| 2016/0207095 | A1 * | 7/2016 | Ochiai | B21K 21/08 |

FOREIGN PATENT DOCUMENTS

| | | | |
|---|---|---|---|
| JP | 2015-074029 | A | 4/2015 |
| KR | 890002206 | B1 | 6/1989 |

OTHER PUBLICATIONS

Japan Patent Office, International Search Report issued in corresponding Application No. PCT/JP2016/004549, dated Dec. 27, 2016.

Japan Patent Office, Written Opinion issued in corresponding Application No. PCT/JP2016/004549, dated Dec. 27, 2016.

* cited by examiner

METHOD FOR MANUFACTURING CYLINDRICAL BODY HAVING DIFFERENT DIAMETERS BY COLD FORGING

TECHNICAL FIELD

The present invention relates to a method for manufacturing, by cold forging, a multi-diameter tubular body, which is a pre-machining workpiece of a multi-diameter tubular component (finished component), such as a metallic shell serving as a main component of a gas sensor adapted to measure oxygen concentration of exhaust gas or a metallic shell serving as a main component of a spark plug; i.e., a workpiece to become a finished component through subjection to cutting, threading, etc.

BACKGROUND ART

FIG. 4 is a sectional view of a gas sensor (e.g., an oxygen sensor; hereinafter, may be called merely a sensor) 1 for use in an automobile, etc., (the same structure as that of the sensor shown in FIG. 5 of Patent Document 1, for example). The sensor 1 includes a multi-diameter tubular metallic shell (a metallic shell body) 10, a tubular detection element (a sensor element) 31 disposed internally of the metallic shell 10 and having a closed forward end (the illustrated lower end), and a protection tube 41 attached to the metallic shell 10 for protecting the interior of the element 31, metal terminal members 71 and 91 disposed within the sensor, etc. Of such components, the metallic shell 10 has a multi-diameter tubular structure; specifically, has a multi-diameter cylindrical portion 11, a polygonal portion 15, and a multi-diameter cylindrical portion 17 which are arranged concentrically from the forward end toward the rear end. The inner circumferential surface of the metallic shell 10 is formed in such a manner that the diameter increases stepwise rearward from the forward end, and has a rearward-facing annular ledge surface (an annular ledge) 24 slightly tapering forward and provided at the boundary between an inner circumferential surface 22 of a small-diameter hole portion 21 located toward the forward end and an inner circumferential surface 26 of a large-diameter hole portion 25 located rearward of the small-diameter hole portion 21. The element 31 is fixed in the metallic shell 10 while an external flange 33 provided on the outer circumferential surface of its axially intermediate region is supported by the rearward-facing annular ledge surface 24 via a packing 51 and a holder 52. The element 31 is fixed by crimping as follows: a seal member 53, a holder 54, etc., are disposed rearward of the external flange 33, and a rear-end thin-walled cylindrical portion 19 of the rear cylindrical portion (also called a tubular portion) 17 of the metallic shell 10 is bent toward the center line and is compressed and deformed forward. The sensor 1 is attached to an exhaust pipe of an automobile or the like via a thread 13 provided on the outer circumferential surface of the forward cylindrical portion (also called a tubular portion) 11 of the metallic shell 10 by turning the polygonal portion 15 for screwing. The sensor 1 is used to perform air-fuel ratio control by generating electromotive force between the inner and outer electrodes thereof on the basis of oxygen concentration difference between the inside and the outside of the element 31, and outputting a signal to a control circuit on the basis of the generated electromotive force to thereby detect oxygen concentration in exhaust gas. In the present application, the forward end of the metallic shell 10 is the lower end in FIG. 4, and the rear end of the metallic shell 10 is the upper end in FIG. 4.

FIG. 5 shows the shape and structure of a multi-diameter tubular body 10*e*, which is formed by cold forging and is a pre-machining workpiece (a workpiece before undergoing cutting and threading) of the metallic shell (a finished component) 10 of the above-mentioned sensor 1. In the following description, like reference numerals are assigned as appropriate to like portions (including substantially identical portions) of the multi-diameter tubular body 10*e*, formed bodies described later and yielded at respective forming stages until formation of the multi-diameter tubular body 10*e*, and the metallic shell (a finished component) 10. The multi-diameter tubular body 10*e* has the polygonal portion (a flange) 15 having a relatively large outside diameter, and tubular portions 11*e* and 17*e* located axially forward and rearward of the polygonal portion 15. In the multi-diameter tubular body 10*e* of FIG. 5, the forward tubular portion 11*e* is formed such that its forward end part forms a small-diameter tubular portion (a small-diameter portion) 12*e* smaller in outside diameter than a rear part of the forward tubular portion 11*e* extending rearward from the forward end part. The multi-diameter tubular body (a workpiece) 10*e* including its inner circumferential surfaces 22*e* and 26*e* is a cold-forged component having shapes and dimensions approximating those of the above-mentioned finished component. As a result, the multi-diameter tubular body 10*e* coaxially has a small-diameter hole portion 21*e* having a small inside diameter and a large-diameter hole portion 25*e* having a relatively large inside diameter and located rearward of the small-diameter hole portion 21*e*, and further has a forward-tapered rearward-facing annular ledge surface 24*e* located at the boundary between the axially located two hole portions and adapted to support the detection element 31 as mentioned above. The multi-diameter tubular body 10*e* of FIG. 5 is formed by subjecting a circular columnar starting material (e.g., SUS430) formed by cutting a round bar short, to a plurality of forming steps consisting of upsetting, hole forming, and extrusion, or to a composite deforming process thereof, so as to gradually increase the degree of deformation, and finally by punching out a region for forming the small-diameter hole portion 21*e* (see FIG. 2(G) in Patent Document 2).

Although unillustrated, as is well known, a spark plug used for ignition in an automobile engine includes a multi-diameter cylindrical metallic shell (a metallic shell body) having a thread formed on its outer circumferential surface for attachment to (threading engagement with) the engine, a tubular insulator inserted through and held in the metallic shell and having a center electrode provided therein and protruding from the forward end thereof, and a ground electrode welded to the forward end of the metallic shell for forming a spark gap in cooperation with the forward end of the center electrode. The basic shape and the structure of a workpiece which is to become such a metallic shell (a finished component) for the spark plug by undergoing cutting, etc., are similar to or resemble those of the above-mentioned sensor; therefore, the workpiece is also manufactured by steps similar to those mentioned above.

Such a multi-diameter tubular body 10*e* is forged by undergoing, for example, the following forming process (see FIG. 6). As shown in FIGS. 6A and 6B, a starting material undergoes a two-stage forming step (a first step and a second step) such as upsetting by axial compression, and extrusion, thereby yielding a first-step formed body 10*a* and a second-step formed body 10*b*. Subsequently, in the third step, the second-step formed body 10*b* undergoes hole forming by driving a punch, and upsetting so as to form a preliminary hole (a recess) 25*c* which is to become the large-diameter hole portion 25*e*, in its rear end surface, and the polygonal portion 15, thereby yielding a third-step formed body 10*c* (see FIG. 6C). Subsequently, the formed body 10*c* undergoes the fourth step in which a punch is thrusted into the preliminary hole 25*c* to extrude a forward end portion thereof and to perform rearward extrusion in deep hole forming, thereby forming a large-diameter hole portion 25*d* and thus yielding a fourth-step formed body 10*d* (see FIG. 6D). Then, in the fifth step, a bottom surface 27*d* of the large-diameter hole portion 25*d* of the formed body is punched out to form the small-diameter hole portion 21*e*, thereby yielding the multi-diameter tubular body (a fifth-step formed body) 10*e* (see FIG. 6E).

The rearward-facing annular ledge surface 24, adapted to support the detection element 31, of the metallic shell 10 manufactured from such a multi-diameter tubular body 10*e* is formed substantially in the above-mentioned fourth step such that the preliminary hole 25*c* of the third-step formed body (see FIG. 6C) 10*c* undergoes deep hole forming (the large-diameter hole portion 25*d* is formed). Specifically, in the fourth step of forming the fourth-step formed body 10*d*, as shown in the left figure (A) of FIG. 7, the third-step formed body 10*c* is placed from its forward end into a die 100*d* having a cavity which can receive a forward part, including the polygonal portion 15, of the third-step formed body 10*c* and which has a region 105*d* having a shape corresponding to the shape of a forward part of the fourth-step formed body 10*d*; then, a deep hole forming punch 120*d* is thrusted into the third-step formed body 10*c* as shown in the right figure (B) of FIG. 7 to thereby finish the large-diameter hole portion (a closed-bottomed hole) 25*d*. That is, as shown in FIG. 7, the forward end surface (the illustrated lower end surface) of the deep hole forming punch 120*d* has an annular surface (an inclined surface) 124*d* inclined toward the center, extending along the outer circumference thereof, and adapted to form the rearward-facing annular ledge surface 24*e* of the multi-diameter tubular body 10*e*. In the subsequent punching step (the fifth step), as shown in the left figure (A) of FIG. 8, the fourth-step formed body 10*d* is placed in a punching die 100*e*; subsequently, as shown in the right figure (B) of FIG. 8, by use of a punch 120*e* for punching, an inner region (a bottom surface) of the bottom surface 27*d* of the large-diameter hole portion 25*d* is punched out. In this punching process, an inclined annular surface (an inclined surface) 24*d* extending along the circumferential edge of the bottom surface 27*d* is left intact. The left annular surface serves as the annular ledge surface 24*e* of the multi-diameter tubular body 10*e*, and the annular ledge surface 24*e* serves as the annular ledge surface 24 of the metallic shell 10.

In the forward end surface of the punch 120*d* used for deep hole forming (the fourth step; FIG. 7) precedent to punching, a region (a central region) located inward of the region (the annular inclined surface) 124*d* extending along the outer circumferential edge and adapted to form the rearward-facing annular ledge surface 24 protrudes forward from the annular inclined surface 124*d* slightly (0.2 mm to 0.5 mm) with a predetermined outside diameter D1, thereby coaxially forming a nib (protrusion) 125*d* having a slightly-tapered-forward surface (see FIG. 7). The primary reason for forming the protrusion 125*d* on the forward end surface of the deep hole forming punch 120*d* is to prevent abrupt imposition of large load (large compressive force) on a bottom surface 27*c* of the preliminary hole 25*c* at an initial stage of deep hole forming (the fourth step); i.e., when the forward end of the punch 120*d* is pressed against the bottom surface 27*c* of the preliminary hole 25*c*, thereby securing positioning or stability of the third-step formed body (a workpiece) 10*c* in the die 100*d* and thus preventing the occurrence of eccentricity and inclination of the large-diameter hole portion 25*d* in the deep hole forming process. Specifically, as a result of provision of the protrusion 125*d*, at the initial stage (from the start of pressing the forward end surface of the protrusion 125*d* against the bottom surface 27*c* of the preliminary hole 25*c* to the end of the step of thrusting the protrusion 125*d*) of forming the large-diameter hole portion 25*d*, the forward end surface of the punch 120*d* is not in full contact with the entire bottom surface 27*c*; therefore, at this initial stage, the load imposed on the workpiece can be rendered relatively small, whereby forming can be free from involvement of occurrence of eccentricity, etc. Particularly, in formation of the fourth-step formed body 10*d*; i.e., in formation of a workpiece from the third-step formed body 10*c* having the preliminary hole 25*c*, by extruding forward a forward end portion of the third-step formed body 10*c* in a diameter reducing manner, and performing deep hole forming together with rearward extrusion, in order to maintain accuracy, after the protrusion 125*d* is pressed against the bottom surface 27*c* of the preliminary hole 25*c*, the forward end portion of the third-step formed body 10*c* must undergo extrusion in a diameter reducing manner, and deep hole forming and rearward extrusion must proceed concurrently.

As shown in the right figure (B) of FIG. 7, and FIG. 9, in the fourth-step formed body 10*d* formed by thrusting the deep hole forming punch 120*d* having such a protrusion 125*d* (the fourth step), the bottom surface (a hole bottom surface) 27*d* of the large-diameter hole portion 25*d* has a depression 28*d*, corresponding to the protrusion 125*d*, formed in a central region thereof. Conventionally, the outside diameter of the protrusion 125*d*; i.e., an inside diameter Dl of the depression formed by the protrusion 125*d*, is approximately equal to the outside diameter of the forward end of the punch 120*e* for punching used in the fifth step; i.e., an inside diameter (the inside diameter of the small-diameter hole portion 21) D2 of the rearward-facing annular ledge surface 24 of the multi-diameter tubular body 10*e* (refer to paragraph 0057 of Patent Document 2). Through employment of such dimensional relation, in punching out the bottom surface 27*d* of the large-diameter hole portion 25*d*, the punch 120*e* for punching can be guided by the inner circumferential surface of the depression 28*d* formed by the protrusion 125*d*. In addition to such dimensional relation, by means of the forward end surface of the punch 120*e* for punching having a forward taper steeper than that of the bottom surface of the depression 28*d*, lubricant (oil) remaining in the depression 28*d* can be discharged, whereby deterioration in accuracy of a finished surface (finished texture) is prevented.

PRIOR ART DOCUMENTS

Patent Documents

Patent Document 1: Japanese Patent Application Laid-Open (kokai) No. 2007-278806

Patent Document 2: Japanese Patent Application Laid-Open (kokai) No. 2002-011543

SUMMARY OF THE INVENTION

Problem to be Solved by the Invention

Meanwhile, in the multi-diameter tubular body (a finished component) 10*e* yielded as mentioned above by forming the large-diameter hole portion 25*d* in the fourth step by use of the deep hole forming punch 120*d* having the protrusion 125*d* on its forward end surface and by, in the subsequent fifth step, punching out the region of the depression 28*d*, formed by the protrusion 125*d*, in the bottom surface 27*d* of the large-diameter hole portion 25*d* to thereby form the small-diameter hole portion 21*e*, as shown in the enlarged view of FIG. 6E, the inner circumferential surface 22*e* of the small-diameter hole portion 21*e* may have an internal flaw K such as a fine crack extending outward in a region located toward the rearward-facing annular ledge surface 24*e*. The rearward-facing annular ledge surface 24*e* is a support surface for supporting the detection element, etc., in the metallic shell (a finished component) yielded through subsequent cutting of a profile, etc., and threading, and assembled with other components to form a sensor. Therefore, the rearward-facing annular ledge surface 24*e* plays a very important role.

The inventors of the present invention conducted various tests, etc., for cause for the occurrence of the internal flaw K, examined and studied the test results, and found the following cause. A "fillet corner" (see the enlarged view in FIG. 7) is formed along the circumferential direction at an intersecting region between an outer circumferential surface 127*d* of the protrusion 125*d* protruding from the forward end surface of the deep hole forming punch 120*d* (see FIG. 7) used in the fourth step and the forward end surface (the annular inclined surface) 124*d* of the punch 120*d* located outward of the protrusion 125*d*. Although the amount of protrusion of the protrusion 125*d* is very small; specifically, 0.2 mm to 0.5 mm, in microscopic view, the "fillet corner" exists in the intersecting region. Accordingly, in forming a deep hole by pressing the forward end surface of the deep hole forming punch 120*d* against the bottom surface 27*c* of the preliminary hole 25*c*, the flow of a metal material in the "fillet corner" is poor. As a result, in the bottom surface 27*d* of the deep hole (the large-diameter hole portion 25*d*) formed by deep hole forming, a convex corner is formed along the circumferential direction in a region corresponding to the "fillet corner"; specifically, in an intersecting region between the inner circumferential surface 29*d* of the depression (a hole) 28*d* formed by the protrusion 125*d* and the surface (the annular surface) 24*d* which is located outward of the depression 28*d* and is to become the rearward-facing annular ledge surface 24. The convex corner is apt to become dead metal, particularly, in cold forging. In actuality, in a vertical section of a formed body (the fourth-step formed body 10*d*) yielded after such deep hole forming, as cut by a plane which contains the axial line, as shown in FIG. 9, the inner circumferential surface 29*d* of the depression 28*d* formed by the protrusion 125*d* has the internal flaw (an internal flaw caused by dead metal) K, such as a crack or wrinkles, extending outward from the bottom surface (or its vicinity) of the depression 28*d* under and along the annular surface 24*d*.

That is, in formation of the fifth-step formed body (the multi-diameter tubular body 10*e*), since the region of the depression 28*d*, formed by the protrusion 125*d*, in the bottom surface 27*d* of the large-diameter hole portion 25*d* of the fourth-step formed body 10*d* is punched out by use of the punch 120*e* having an outside diameter D2 approximately equal to the inside diameter D1 of the depression 28*d* to thereby form the small-diameter hole portion 21*e*, as shown in FIG. 9, the internal flaw K, such as a crack, caused by dead metal remains intact in a region, near the rearward-facing annular ledge surface 24*e*, of the inner circumferential surface 22*e* of the small-diameter hole portion 21*e*. Notably, since a multi-diameter tubular body used to form the metallic shell for a spark plug has a shape and structure having a "rearward-facing annular ledge surface" similar to that of a multi-diameter tubular body used to form the metallic shell for a sensor and is manufactured similarly, a problem similar to the above-mentioned problem is involved. The ledge surface is a support surface for supporting an insulator which surrounds a center electrode, and thus plays an important role.

The present invention has been conceived in view of the above problem involved in cold-forging a multi-diameter tubular body used to form a metallic shell serving as a component of a gas sensor or a spark plug and having a rearward-facing annular ledge surface on an inner circumferential surface for supporting an element or an insulator, and an object of the invention is to prevent the occurrence of an internal flaw such as a crack in the rearward-facing annular ledge surface.

Means for Solving the Problem

In accordance with one aspect, the present invention provides a method for manufacturing a multi-diameter tubular body having an axially extending through hole by cold forging, the multi-diameter tubular body including a small-diameter hole portion having a small inside diameter and a large-diameter hole portion having a relatively large inside diameter, which are coaxially arranged rearward from a forward end of the multi-diameter tubular body, the multi-diameter tubular body further having a rearward-facing annular ledge surface tapering forward and located at a boundary between the small-diameter hole portion and the large-diameter hole portion. The method includes: forming a preliminary hole for the large-diameter hole portion in a rear end surface of a columnar starting material; forming the large-diameter hole portion; and forming the rearward-facing annular ledge surface and the small-diameter hole portion.

Forming the preliminary hole for the large-diameter hole portion in the rear end surface of the columnar starting material includes subjecting the starting material to one or a plurality of forming steps.

Forming the large-diameter hole portion includes subjecting the preliminary hole to deep hole forming by thrusting a deep hole forming punch into the preliminary hole. The deep hole forming punch has an annular inclined surface which is located in a region of its forward end surface extending along an outer circumference of the forward end surface and which is inclined toward a center so as to form the rearward-facing annular ledge surface in the multi-diameter tubular body. The deep hole forming punch further has a protrusion which is located coaxially at the center of the forward end surface and inward of the annular inclined surface, protrudes forward, and has a predetermined outside diameter. The large-diameter hole portion is formed such that the large-diameter hole portion has, on a bottom surface thereof, an annular surface which is to become the rearward-facing annular ledge surface, and a depression formed inward of the annular surface by the protrusion.

Forming the rearward-facing annular ledge surface and the small-diameter hole portion includes driving a punch for punching into a bottom surface of the large-diameter hole portion so as to punch out the bottom surface of the large-diameter hole portion such that the rearward-facing annular ledge surface is left.

The method is characterized in that an outside diameter D1 of the protrusion of the deep hole forming punch is smaller than an inside diameter D2 of the small-diameter hole portion.

According to one implementation, when the punch for punching is driven, an outer circumferential surface of the punch for punching is guided by an inner circumferential surface of the large-diameter hole portion formed through deep hole forming by the deep hole forming punch.

According to another implementation, the punch for punching has a communication hole extending therethrough for establishing communication between a forward end surface thereof and a rear region thereof so as to prevent the forward end surface of the punch from closing the depression formed by the protrusion.

Effects of the Invention

Even in the manufacturing method of the present invention, since deep hole forming uses a deep hole forming punch having a protrusion protruding from its forward end surface, a "fillet corner" is formed along the circumferential direction at an intersecting region between the outer circumferential surface of the protrusion and the forward end surface of the punch located outward of the protrusion. In forming the large-diameter hole portion through deep hole forming by use of such a punch, a depression is formed by the protrusion in a central region of the bottom surface of the large-diameter hole portion. Therefore, a convex corner is formed along the circumferential direction in an intersecting region between the inner circumferential surface of the depression at this stage and the surface which is located outward of the depression and is to become the rearward-facing annular ledge surface after formation of the small-diameter hole portion by punching. Similar to the case of the conventional manufacturing method, such a convex corner is apt to become dead metal. As a result, similar to the conventional case, the inner circumferential surface of the depression formed by the protrusion may have an internal flaw caused by dead metal, such as a crack or wrinkles, extending outward from the bottom surface (or a region in the vicinity of the bottom surface) of the depression under and along the surface which is to become the annular ledge surface.

However, according to the present invention, the outside diameter D1 of the protrusion of the deep hole forming punch is smaller than the inside diameter D2 of the small-diameter hole portion to be formed by punching (D2>D1). That is, according to the present invention, the outside diameter D1 of the protrusion (the inside diameter of the depression formed by the protrusion) is smaller than a punching diameter (the inside diameter D2 of the small-diameter hole portion) in subsequent punching of the bottom surface of the large-diameter hole portion. As a result, a portion located inward of the surface which is to become the rearward-facing annular ledge surface after punching, and located outward of the depression formed by the protrusion; i.e., a portion between the inside diameter D2 of the small-diameter hole portion and the outside diameter D1 of the protrusion, is also punched out in this punching process. Thus, an internal flaw, such as a crack, which is generated on the inner circumferential surface of the depression formed by the protrusion and extends outward is partially removed, as punching scrap in the punching process, in a portion (region) between the inside diameter D2 of the small-diameter hole portion and the outside diameter D1 of the protrusion. As a result, according to the present invention, there can be reduced the occurrence of an internal flaw in the rearward-facing annular ledge surface in the multi-diameter tubular body yielded after the punching process.

Notably, the depth of an internal flaw extending radially outward from the inner circumferential surface of the depression formed by the protrusion; i.e., a region of generation of an internal flaw in a surface which is to become the annular ledge surface, depends on dimensions of the multi-diameter tubular body, the amount of protrusion of the protrusion of the deep hole forming punch, fluidity of a metal material subjected to forging, etc. Meanwhile, a region in which an internal flaw extends radially outward from the inner circumferential surface of the depression formed by the protrusion can be specified by, for example, cutting a formed test sample. The inside diameter D2 of the small-diameter hole portion can be determined in accordance with the size of the multi-diameter tubular body. Therefore, on the basis of the specified region, the outside diameter (dimension) D1 of the protrusion may be determined such that, when the small-diameter hole portion is formed by punching, a portion to be removed is removed together with an internal flaw contained therein, as punching scrap, by punching (simultaneous punching). Notably, the multi-diameter tubular body to be manufactured according to the present invention is not limited to a pre-machining workpiece of the metallic shell for a sensor, but is applicable to a pre-machining workpiece of the metallic shell for a spark plug.

According to the present invention, since the punch for punching is not guided by the depression formed by the protrusion, as described in claim 2, the outer circumferential surface of the punch is desirably guided by the inner circumferential surface of the large-diameter hole portion. According to the present invention, although the outside diameter D2 of the punch for punching is greater than the inside diameter D1 of the depression formed by the protrusion, through employment of the feature described in claim 3, closing the depression by the forward end surface of the punch can be prevented. As a result, lubricant remaining within the depression can be discharged rearward through the communication hole, thereby preventing roughening of texture of a formed surface, which could otherwise result from confinement of lubricant.

MODES FOR CARRYING OUT THE INVENTION

Figure 5:
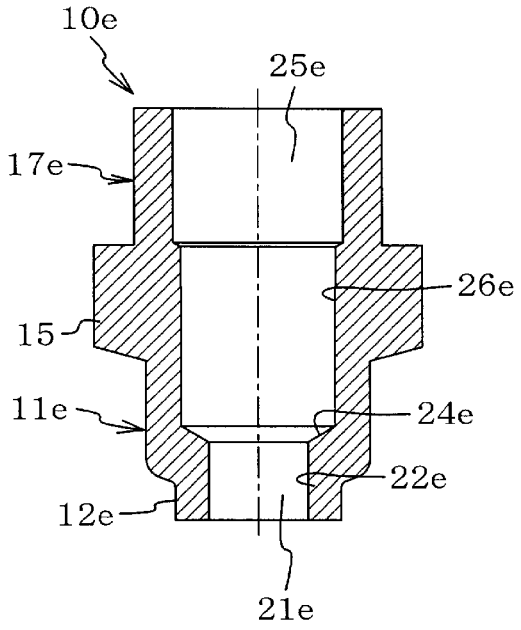
FIG. 5 Sectional view of a pre-machining workpiece, or a formed body (a multi-diameter tubular body) formed by cold forging, of a metallic shell (a finished component) for use in the gas sensor of FIG. 4.
Figure 6:
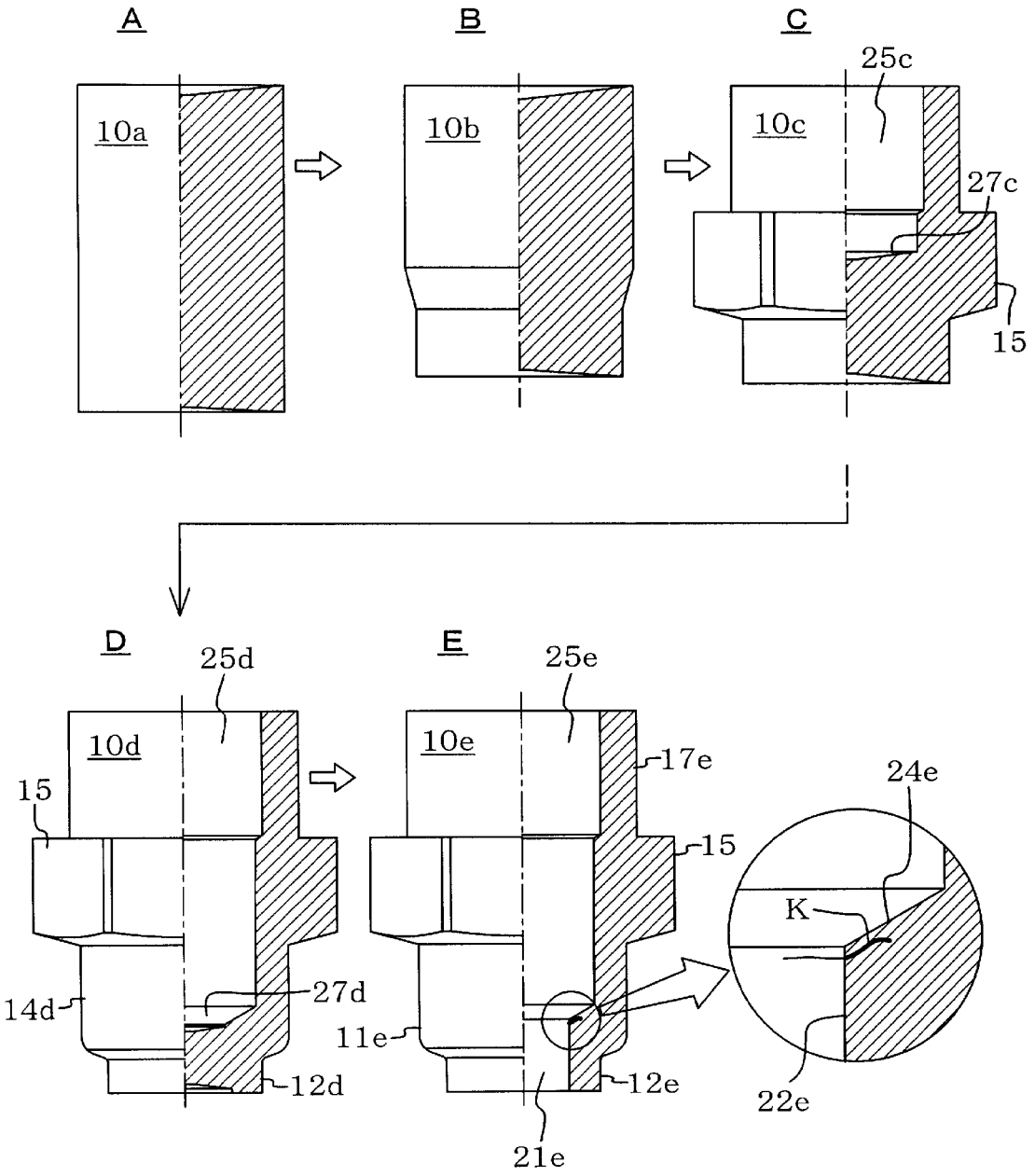
FIG. 6 Half-sectional views showing an example of steps for forming the formed body by cold forging (the multi-diameter tubular body) of FIG. 5, and adapted to explain formed bodies formed in the respective steps.
Figure 7:
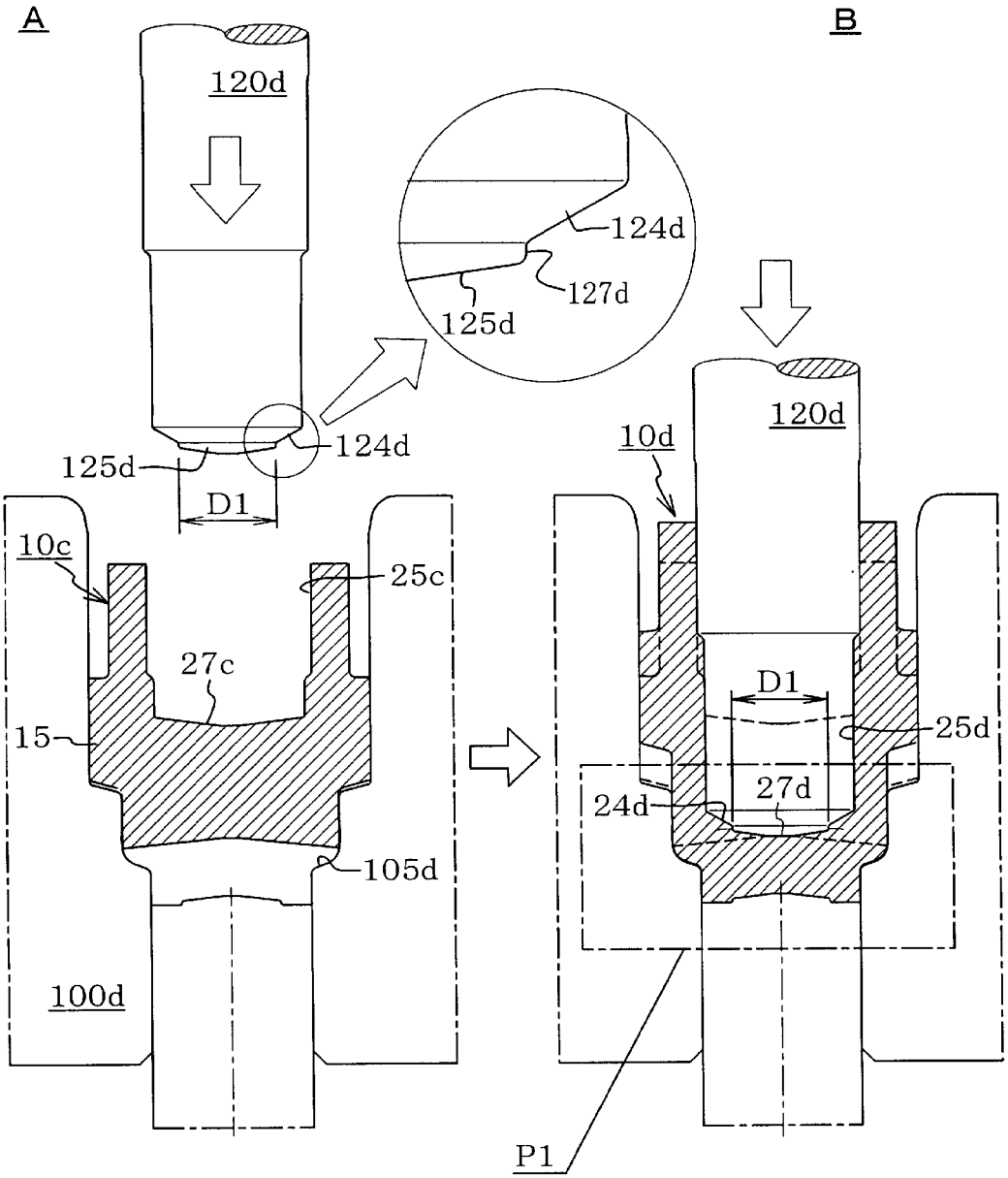
FIG. 7 Sectional views for explaining, of the conventional steps for forming the formed body (FIG. 6E) of FIG. 5, a deep hole forming (large-diameter hole forming) step (a fourth step) in which the preliminary hole of the third-step formed body (FIG. 6C), or an intermediate formed body yielded after formation of the preliminary hole, undergoes deep hole forming (large-diameter hole portion forming), including the illustration of a die, etc.
Figure 8:
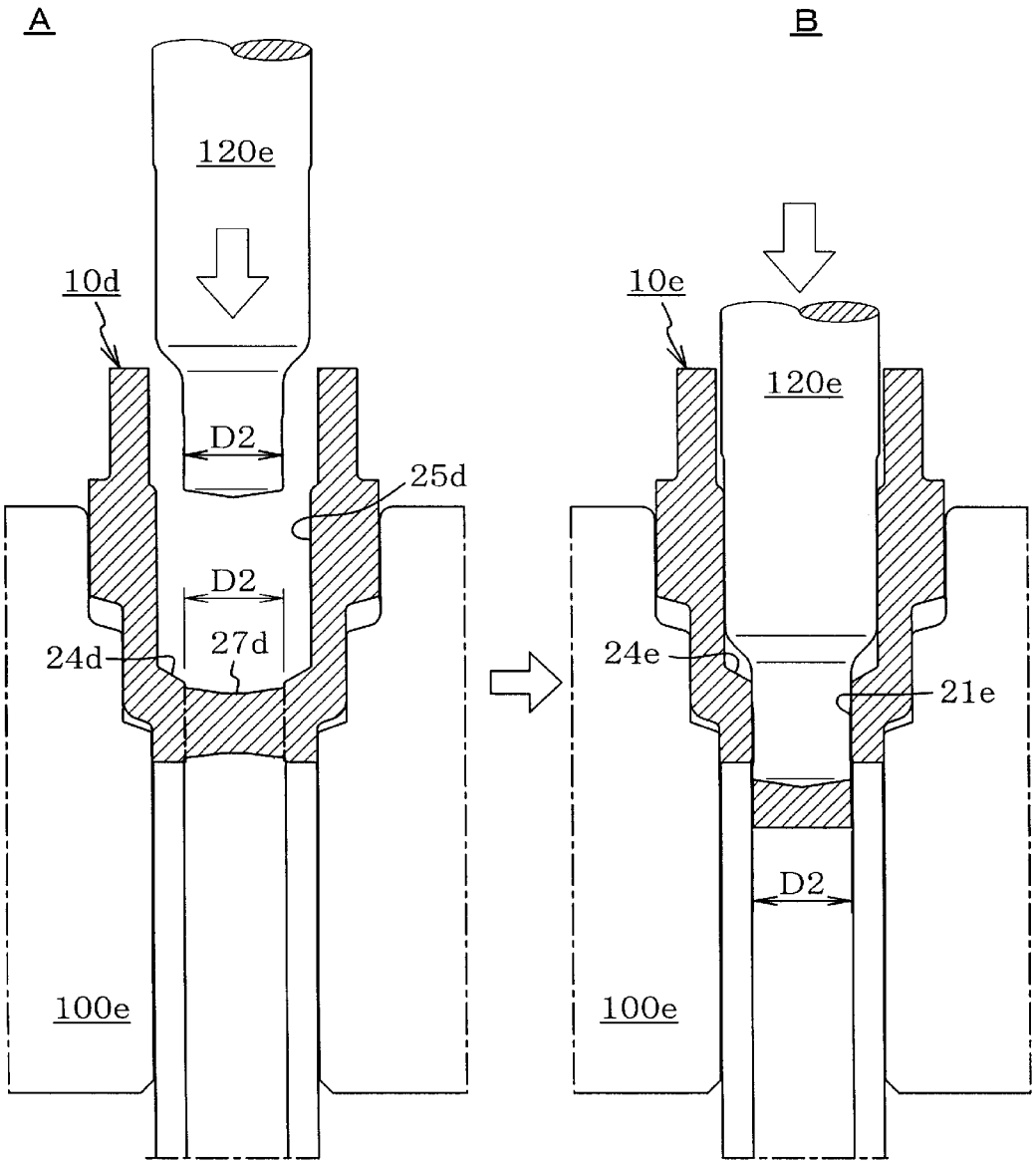
FIG. 8 Sectional views for explaining, of the conventional steps for forming the formed body (FIG. 6E) of FIG. 5, a punching (small-diameter hole forming) step (a fifth step) in which a fourth-step formed body yielded after deep hole forming (large-diameter hole portion forming) undergoes punching, including the illustration of a die, etc.
Figure 9:
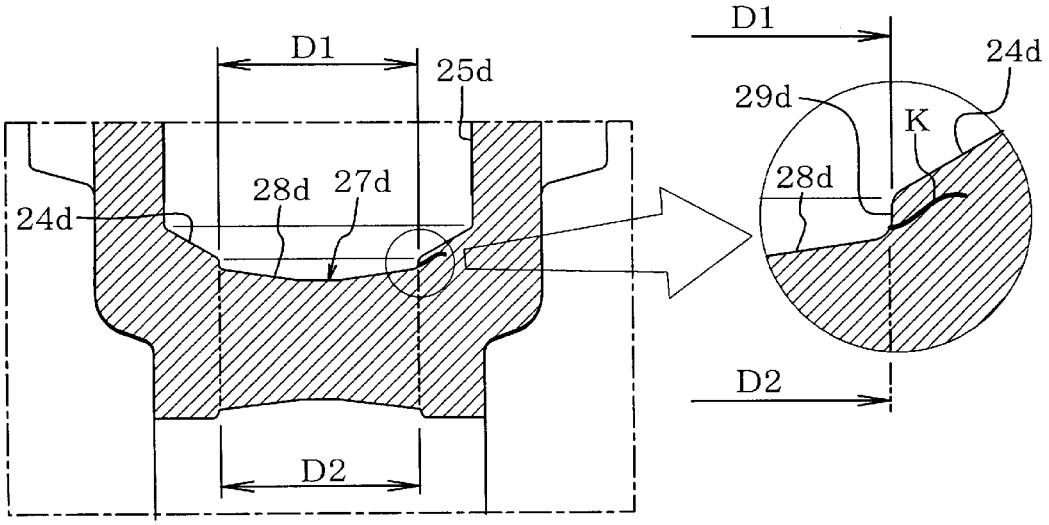
FIG. 9 Enlarged view of the P1 region in FIG. 7 for explaining flaw generated in a rearward-facing annular ledge surface of the fourth-step formed body yielded after deep hole forming (large-diameter hole portion forming) in FIG. 7.

An embodiment of a method for manufacturing a multi-diameter tubular body by cold forging according to the present invention will next be described in detail with reference to FIGS. 1 to 3. The multi-diameter tubular body manufactured in the present embodiment is the same as that shown in FIG. 5 (FIG. 6E). Also, the steps of manufacturing the multi-diameter tubular body are the same as those for forming the respective formed bodies (A to E) shown in FIG. 6. Specifically, by subjecting a columnar starting material to a plurality of forming steps as shown in FIGS. 6A and 6B, there is formed a third-step formed body 10*c* having a preliminary hole 25*c* of a large-diameter hole portion 25*d* formed in its rear end surface as shown in FIG. 6C; subsequently, in a fourth step, the preliminary hole 25*c* is subjected to deep hole forming by thrusting a deep hole forming punch thereinto, thereby forming the large-diameter hole portion 25*d* and thus yielding a fourth-step formed body 10*d*; then, in a fifth step, a bottom surface 27*d* of the large-diameter hole portion 25*d* is punched out by driving a punch for punching, thereby forming a small-diameter hole portion 21*e* and thus yielding a multi-diameter tubular body 10*e*. Thus, the manufacturing method is basically the same as the conventional manufacturing method, but differs only in that the outside diameter D1 of a protrusion 125*d* protruding forward from the forward end surface of a deep hole forming punch 120*d* used to subject the preliminary hole 25*c* to deep hole forming in the fourth step (see FIG. 7) is rendered substantially smaller by an appropriate amount than the inside diameter D2 of the small-diameter hole portion 21*e*. The process of yielding a fifth-step formed body (a finished multi-diameter tubular component) from the third-step formed body 10*c* shown in FIG. 6, together with dies, punches, etc., used in the fourth and fifth step, will be further described in detail.

First, the third-step formed body 10*c* to be formed in the fourth step will be described (see FIG. 6, etc.). The third-step formed body 10*c* is formed from a second-step formed body 10*b* in such a manner as to have a forward circular columnar portion, a rearward cylindrical portion, and a portion which protrudes from an outer circumferential surface located axially between the forward circular columnar portion and the rearward cylindrical portion and which is to become a polygonal portion 15 of a metallic shell 11. The rearward cylindrical portion corresponds to a rearward tubular portion 17*e* of the multi-diameter tubular body (see FIG. 5) 10*e*. As shown in FIG. 6C, the third-step formed body 10*c* has a recess in its rear end surface (center), and the recess serves as the preliminary hole 25*c* of a large-diameter hole portion 25. The preliminary hole 25*c* consists of holes having different diameters such that a rearward hole is slightly larger in diameter than a forward hole; the forward hole (the polygonal portion 15) has a diameter approximately equal to the inside diameter of the large-diameter hole portion to be formed by subsequent deep hole forming; and the rearward hole has an inner diameter slightly larger than that of the forward hole so as to be approximately equal to the inside diameter of the rearward tubular portion 17*e*. In the present embodiment, a bottom surface 27*c* of the preliminary hole 25*c* is located at an axially intermediate position of the polygonal portion 15 and slightly tapers forward toward its center.

Meanwhile, in the fourth step, the fourth-step formed body (FIG. 6D) 10*d* is formed from the third-step formed body (FIG. 6C) 10*c* by deep hole forming in such a manner that: a forward end portion of a portion (a cylindrical portion) located forward of the polygonal portion 15 is extruded forward while being reduced in diameter, and the portion is also extruded rearward by deep hole forming; deep hole forming also causes rearward extrusion to thereby form the large-diameter hole portion 25*d*; and a portion (a tubular portion to be threaded) 14*d* between the polygonal portion 15 and a forward end portion (a small-diameter portion) 12*d* is elongated to thereby form a tubular portion greater in diameter than the small-diameter portion 12*d* of a multi-diameter cylinder. The bottom surface 27*d* of the large-diameter hole portion 25*d* to be punched out for forming a small-diameter hole portion is located slightly rearward (upward in the illustration) of the forward end of the relatively large diameter portion to be threaded.

Figure 1:
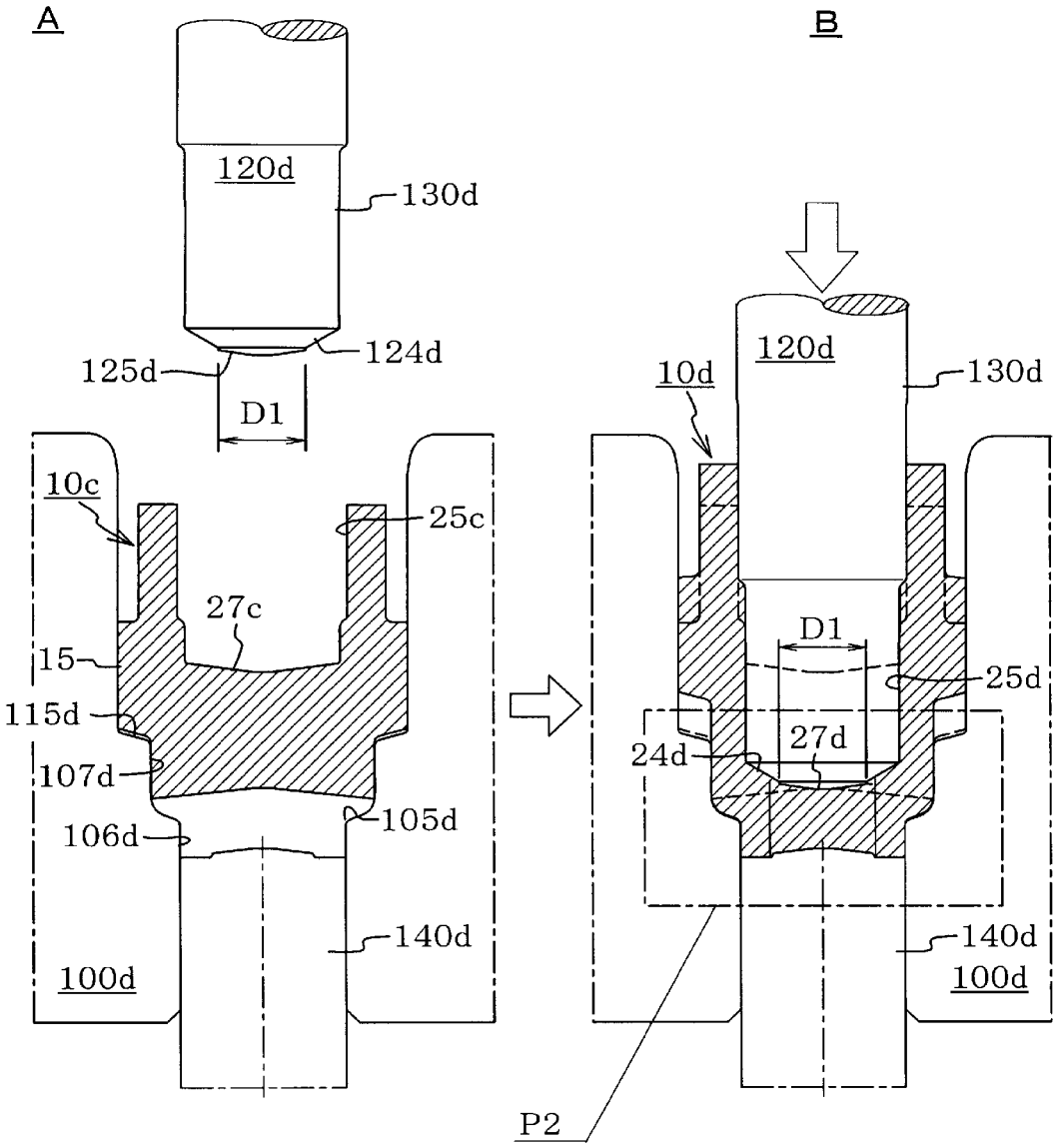
FIG. 1 Sectional views for explaining an embodiment of a manufacturing method of the present invention; specifically, a deep hole forming (large-diameter hole portion forming) step (a fourth step) in which a preliminary hole of a third-step formed body (FIG. 6C), or an intermediate formed body yielded after formation of the preliminary hole, undergoes deep hole forming, including the illustration of a die, etc.

As shown in FIG. 1, a die 100*d* used to form the fourth-step formed body 10*d* from the third-step formed body 10*c* having the preliminary hole by deep hole forming has a cavity which receives a forward portion of the third-step formed body 10*c*, including the polygonal portion 15, with a very small gap formed therebetween and whose profile includes a shape 105*d* corresponding to a forward portion of the fourth-step formed body 10*d*. The cavity has a circular hole 106*d* and a circular hole 107*d* so as to allow formation of the tubular portion 11*e* of the multi-diameter cylinder. The circular hole 106*d* is located on the forward end side and has a small diameter. The circular hole 107*d* is located rearward of the circular hole 106*d* and has a diameter greater than that of the circular hole 106*d*. The circular hole 107*d* can receive the outer circumferential surface of a forward end portion of the third-step formed body 10*c* and is adapted to form the tubular portion 11*e* to be threaded. The die 100*d* further has a polygonal hole located rearward of the two circular holes and capable of receiving the polygonal portion 15 of the third-step formed body 10*c* with a very small gap formed therebetween. These holes (the cavity) of the die 100*d* assume the form of a concentrically multi-diameter hole which increases in diameter from the forward side to the rearward side. In consideration of rearward extrusion (elongation) of material in the course of deep hole forming, the intermediate circular hole 107*d* is set shorter in axial length than a tubular portion of the tubular portion 11*e* which is to be threaded. For supporting the forward end surface of the fourth-step formed body 10*d* and ejecting a formed body, a knock pin (a circular columnar body) 140*d* is disposed in the circular hole 106*d* in a lower region of the die 100*d*.

The deep hole forming punch 120*d* used in the fourth step has a shaft portion (a circular columnar portion) 130*d* formed in such a manner as to be capable of forming the large-diameter hole portion 25*d* having a predetermined length and a predetermined diameter and to be capable of being inserted into the preliminary hole 25*c*. The forward end surface of the deep hole forming punch 120*d* has an annular inclined surface 124*d* extending along its outer circumference and inclined toward the center for forming a rearward-facing annular ledge surface 24*e* of the multi-diameter tubular body (see FIGS. 5 and 6E) 10*e*. The forward end surface of the deep hole forming punch 120*d* also has a circular protrusion 125*d* having a predetermined outside diameter Dl and protruding forward slightly (0.2 mm to 0.5 mm) coaxially at its center from the annular inclined surface 124*d*. The protrusion 125*d* is formed in such a manner that its outer circumferential edge is located inside (on a center side of) the inner circumferential edge of the rearward-facing annular ledge surface 24*e* of the multi-diameter tubular body 10*e* (the inner circumferential surface of the small-diameter hole portion 21*e*). That is, in contrast to the conventional case in which the outside diameter D1 of the protrusion 125*d* is approximately equal to the inside diameter D2 of the small-diameter hole portion 21*e* to be formed later by punching, the outside diameter D1 of the protrusion 125*d* is set smaller by an appropriate amount than the inside diameter D2 of the small-diameter hole portion 21*e*. The annular inclined surface 124*d* has the same taper as that of the rearward-facing annular ledge surface 24*e* of the multi-diameter tubular body 10*e*, and, in the present embodiment, the protrusion 125*d* is also tapered such that the center of its forward end surface slightly protrudes.

In the fourth step, the third-step formed body 10*c* is placed in the die 100*d* (left figure (A) of FIG. 1), and, as shown in the right figure (B) of FIG. 1, the deep hole forming punch 120*d* is thrusted by a predetermined amount into the preliminary hole (recess) 25*c* of the third-step formed body 10*c*, thereby yielding the fourth-step formed body 10*d*. At the initial stage of thrusting, the protrusion 125*d* of the forward end surface of the deep hole forming punch 120*d* is pressed against the bottom surface 27*c* of the preliminary hole 25*c* to thereby form a depression corresponding to the protrusion 125*d* in the bottom surface 27*c*. As thrusting proceeds, a forward end portion of the third-step formed body 10*c* is extruded forward within the forward circular hole 106*d* of the die 100*d*; and, at the same time, deep hole forming proceeds, whereby a rear portion, including the polygonal portion 15, of the third-step formed body 10*c* is extruded relatively rearward. As a result of completion of thrusting of the deep hole forming punch 120*d* over a predetermined stroke (by a predetermined amount), forming of the large-diameter hole portion (deep hole forming) ends, thereby yielding the fourth-step formed body 10*d* shown in the right figure (B) of FIG. 1. In the thus-yielded fourth-step formed body 10*d*, the profile of the forward end surface of the deep hole forming punch 120*d* is transferred to the bottom surface 27*d* of the large diameter hole portion 25*d* of the fourth-step formed body 10*d*. Therefore, a depression 28*d* is formed by the protrusion 125*d* at the center of the bottom surface 27*d*; an annular surface 24*d* which is to become the rearward-facing annular ledge surface 24 is formed in a region of the bottom surface 27*d* located outward of the depression 28*d*; and an intersecting region between the annular surface 24*d* and an inner circumferential surface 29*d* of the depression 28*d* becomes a convex corner (see FIG. 2) along the circumferential direction. Such features are similar to the case of the conventional process. As a result, as shown in the enlarged view of FIG. 2, the inner circumferential surface 29*d* of the depression 28*d* may have the internal flaw K, such as a crack or wrinkles, caused by dead metal and extending outward from the bottom surface (or its vicinity) of the depression 28*d* under the annular surface 24*d* located outward of the inner circumferential surface 29*d*. Such occurrence of flaw is similar to the case of the conventional process.

Figure 2:
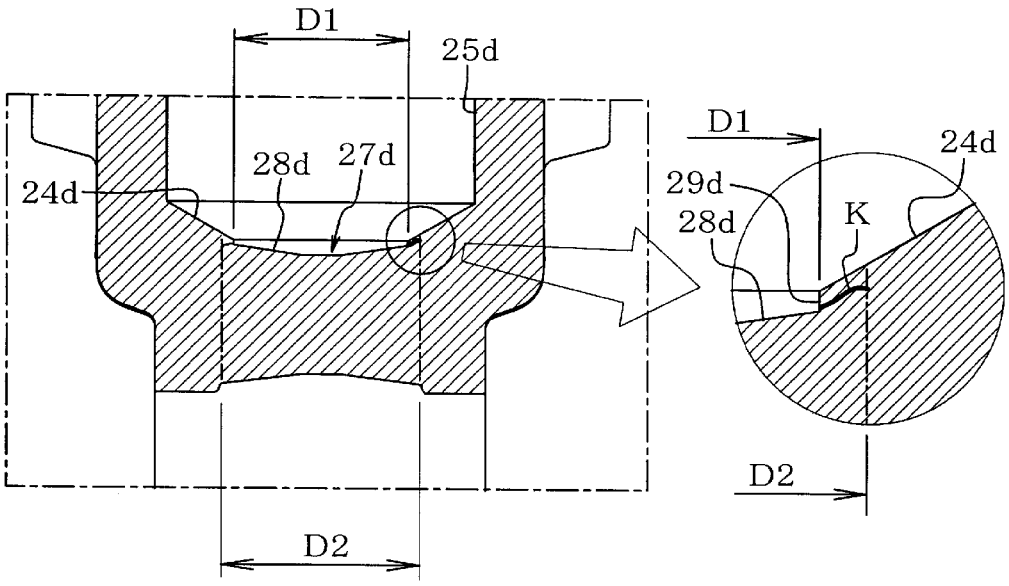
FIG. 2 Enlarged view of the P2 region in FIG. 1 for explaining the position of flaw (crack) generated in a rearward-facing annular ledge surface of a fourth-step formed body yielded after deep hole forming (large-diameter hole portion forming) in FIG. 1.
Figure 3:
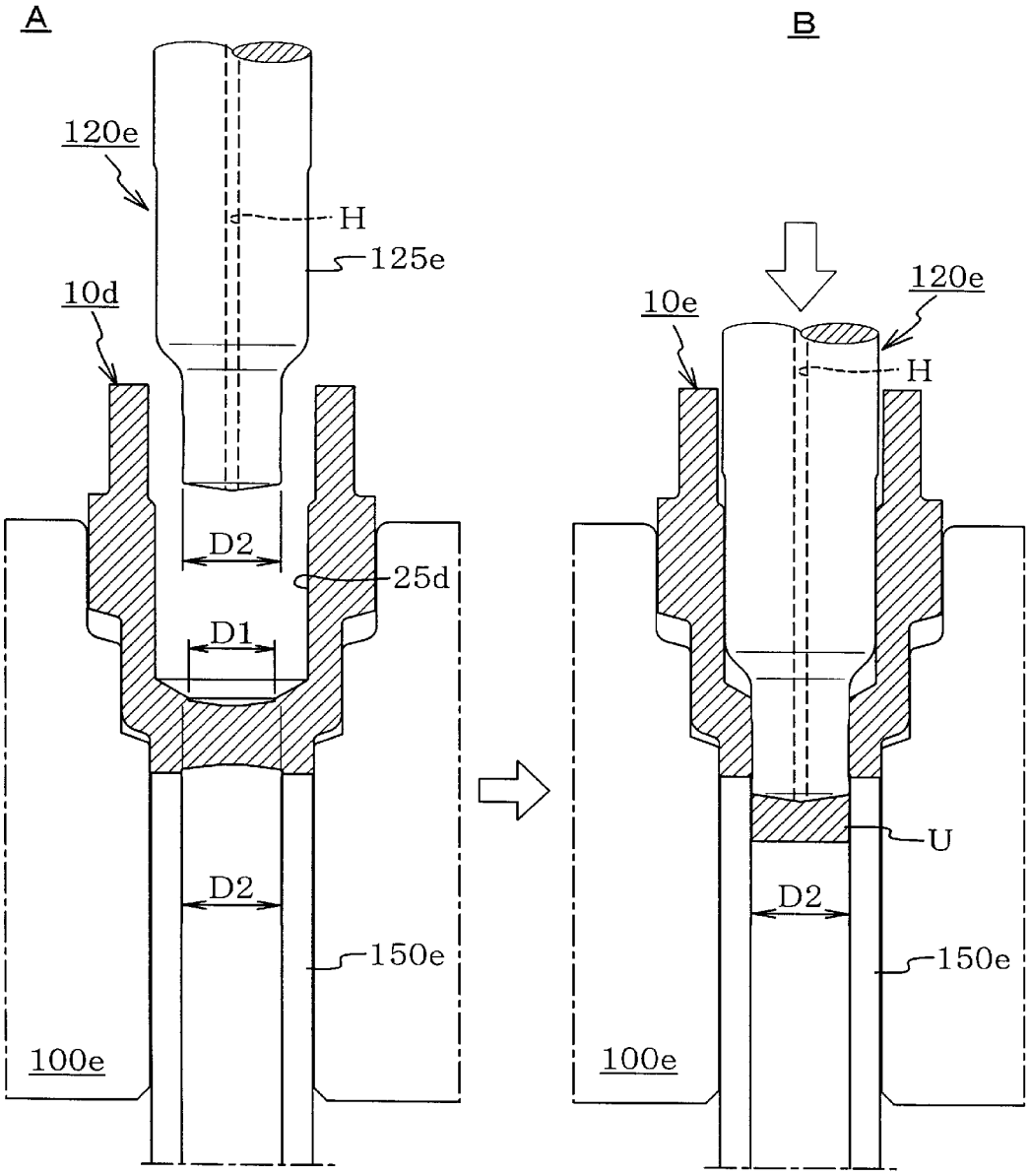
FIG. 3 Sectional views for explaining a punching (small-diameter hole forming) step (a fifth step) in which a fourth-step formed body yielded after deep hole forming (large-diameter hole portion forming) in FIG. 1 undergoes punching, including the illustration of a die, etc.
Figure 4:
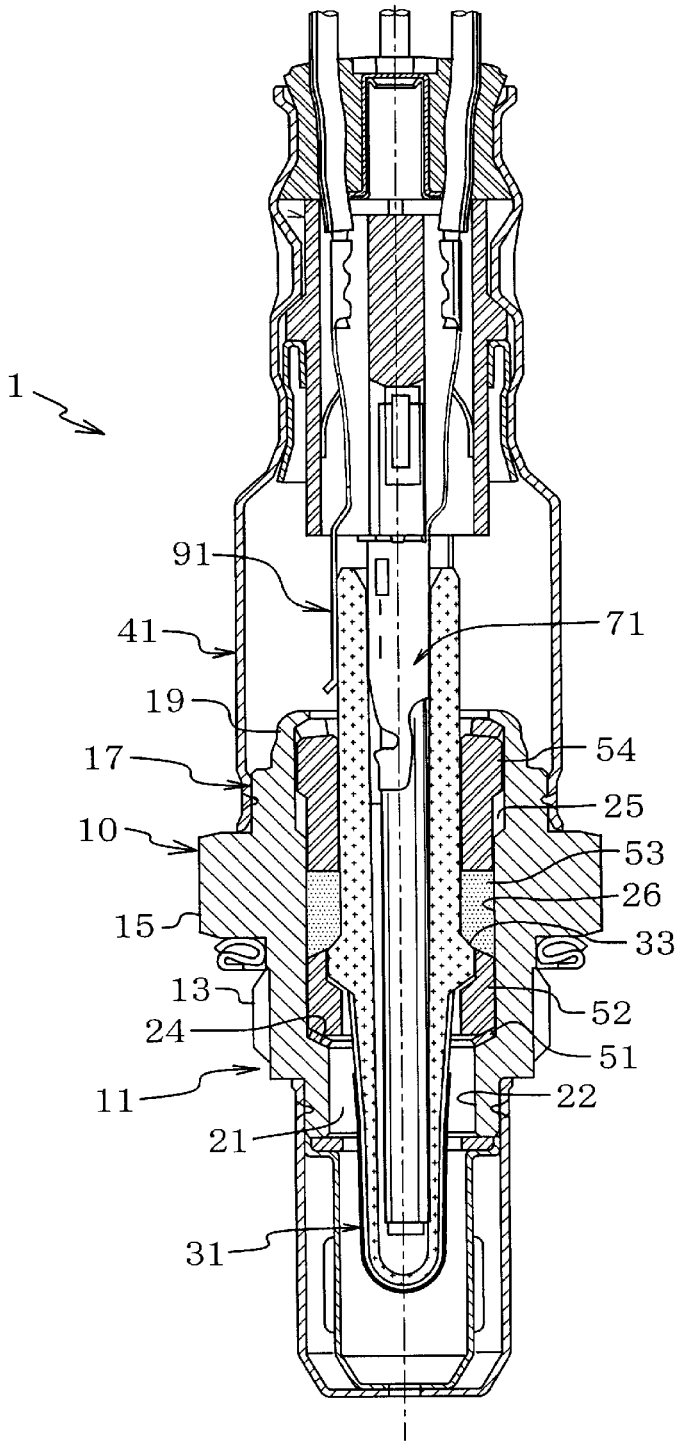
FIG. 4 Sectional view for explaining an example of a conventional gas sensor, showing the schematic configuration of the gas sensor.

However, as mentioned above, the outside diameter D1 of the protrusion 125*d* of the deep hole forming punch 120*d* is smaller than the inside diameter D2 of the small-diameter hole portion 21*e* to be formed in the next step (fifth step) by punching by use of a punch for punching (see FIG. 2). As a result, the internal flaw K, such as a crack, is removed. Specifically, similar to the case of the conventional process, the fourth-step formed body 10*d* is placed in the die 100*e* for use in punching in the fifth step as shown in the left figure (A) of FIG. 3, and then, as shown in the right figure (B) of FIG. 3, a punch 120*e* for punching which has a forward end outside diameter corresponding to the inside diameter D2 of the small-diameter hole portion 21*e* is driven into the bottom surface 27*d* so as to form the small-diameter hole portion 21*e*. As a result, a portion of the annular surface 24*d* located outward of the depression 28*d* formed by the protrusion 125*d* and inward of a surface which is to become the rearward-facing ledge surface 24 (a portion between the inside diameter D2 of the small-diameter hole portion 21*e* and the outside diameter D1 of the protrusion 125*d*) is punched out and removed as a punching scrap U. That is, as shown in the enlarged view of FIG. 2, the internal flaw K, such as a crack, etc., present outward of the depression 28*d* and inside the diameter D2 is removed together with the punching scrap U when the small-diameter hole portion 21*e* is formed (by punching). Thus, in the multi-diameter tubular body 10*e* yielded after the punching process, the existence of an internal flaw in the rearward-facing annular ledge surface 24*e* can be reliably reduced as compared with the conventional manufacturing method in which D1 and D2 are approximately equal to each other.

The die 100*e* used in the fifth step has substantially the same structure as that of the die used in the fourth step; i.e., the die 100*e* has a cavity which receives the fourth-step formed body 10*d* with approximately no gap formed therebetween. However, a forward end support (a knock pin) 150*e* has such a pipe structure as not to interfere with the punch 120*e* for punching. In the punch 120*e* for punching, a rearward shaft portion 125*e* is rendered greater in outside diameter than a forward shaft portion (a circular columnar portion) having a punching diameter, so as to have such an outside diameter as to be guided by the inner circumferential surface of the large-diameter hole portion 25*d* in the punching process. The punch 120*e* has a lubricant discharge hole H which has openings (not shown) in the forward end surface and a rearward side surface and establishes communication between the openings.

In the present embodiment described above, the outside diameter (dimension) D1 of the protrusion 125*d* of the deep hole forming punch 120*d* may be determined as mentioned above on the basis of the degree of dependence of the depth of the internal flaw K extending radially outward from the inner circumferential surface of the depression 28*d* formed by the protrusion 125*d*; i.e., the degree of dependence of a region of generation of the internal flaw in a surface which is to become the annular ledge surface 24, on dimensions, shape, structure, etc., of the multi-diameter tubular body 10*e*, which degree of dependence is found by, for example, cutting a formed test sample. The outside diameter (dimension) D1 of the protrusion 125*d* may be determined such that punching scrap to be removed contains the generated internal flaw K as much as possible in forming the small-diameter hole portion 21*e* by punching (simultaneous punching).

In the present embodiment, since the rearward shaft portion 125*e* of the punch 120*e* for punching has such an outside diameter as to be guided by the internal circumferential surface of the large-diameter hole portion 25*d* in the punching process, punching can be performed accurately and stably without involvement of any eccentricity. Although the dimensional relation D2>D1 is employed, since the punch 120*e* for punching has the lubricant discharge hole H establishing communication between the forward end surface thereof and a rearward side surface thereof, the forward end surface of the punch 120*e* can be prevented from closing the depression 28*d* formed by the protrusion. Thus, since lubricant remaining in the depression 28*d* can be discharged rearward through the communication hole H, there is prevented roughening of texture of a formed surface, which could otherwise result from confinement of lubricant.

Meanwhile, the multi-diameter tubular body 10*e* of the present embodiment has a small-diameter tubular portion (a small-diameter portion) 12*e* having a relatively small outside diameter in a forward end part of the forward tubular portion 11*e* thereof. In the course of forming the large-diameter hole portion 25*d*, a small diameter portion which is to become the small-diameter tubular portion (the small-diameter portion) 12*e* is thrusted into the forward small circular hole 106*d* of the die 100*d* and undergoes extrusion for forming. Thus, in order to perform forming without involvement of eccentricity, etc., in thrusting the deep hole forming punch 120*d* (the fourth step), it is preferred that the outside diameter Dl of the protrusion 125*d* be determined such that the following change proceeds in the thrusting process. At the initial stage of the thrusting process, the protrusion 125*d* of the forward end surface of the deep hole forming punch 120*d* is pressed against the bottom surface 27*c* of the preliminary hole 25*c* of the third-step formed body 10*c* and presses the bottom surface 27*c* forward with a relatively small load (pressing load) so as to establish a state in which the forward-facing surface of the polygonal portion 15 of the third-step formed body is supported by a rearward-facing annular polygonal surface 115*d* of the die 100*d*; subsequently, the protrusion 125*d* further presses the bottom surface 27*c* to thereby form depression in the bottom surface 27*c* of the preliminary hole 25*c*; then, a small-diameter portion which is to form the small-diameter tubular portion (small-diameter portion) 12*e* is extruded forward into the circular hole 106*d*; subsequently, substantial deep hole forming is performed to thereby form the large-diameter hole portion 25*d* through rearward extrusion.

Here, L1 is taken as load to be imposed until the protrusion 125*d* is thrusted into the bottom surface 27*c* of the preliminary hole 25*c*, and then, the forward end surface of the deep hole forming punch 120*d* is pressed against the entire bottom surface 27*c* of the preliminary hole 25*c*. Subsequently, as the thrusting process proceeds, load increases, and L2 is taken as load to be imposed until the small-diameter portion which is to form the forward small-diameter tubular portion (small-diameter portion) 12*e* is extruded forward to thereby form the small-diameter tubular portion 12*e*. L3 is taken as load to be imposed next until completion of forming of the large-diameter hole portion 25*d* (deep hole forming) by rearward extrusion (elongation) by progress of deep hole forming as a result of the punch 120*d* being further thrusted. In this case, in addition to employment of the dimensional relation such that the outside diameter D1 of the protrusion 125*d* is smaller than the inside diameter D2 of the small-diameter hole portion 21*e*, it is preferred that these loads L1, L2, and L3 be in the following relation: L1<L2, L1<L3, and L2≤L3.

The above embodiment is described while referring to the case where the multi-diameter tubular body 10*e* is formed from a starting material through five steps; specifically, in the third step, the third-step formed body 10*c* having the preliminary hole 25*c* is formed; in the fourth step, the third-step formed body 10*c* is subjected to deep hole forming; and, in the fifth step, punching is performed. However, in the present invention, the number of steps until formation of a multi-diameter tubular body may be determined as appropriate according to a specific dimensional aspect (height, diameter, thickness, etc.) ratio of the multi-diameter tubular body and the degree of difficulty of forming (or deformability of a metal material). The shape and structure of the multi-diameter tubular body (pre-machining workpiece of the metallic shell for use in a sensor or a spark plug) are not limited to those of the above embodiment. The multi-diameter tubular body may have a shape and a structure in which a multi-diameter profile is modified as appropriate according to positions of machining, machining allowances, etc.

DESCRIPTION OF REFERENCE NUMERALS

10*e*: multi-diameter tubular body
21*e*: small-diameter hole portion
24*e*: rearward-facing annular ledge surface
24*d*: annular surface which is to become rearward-facing annular ledge surface
25*e*: large-diameter hole portion
25*c*: preliminary hole for large-diameter hole portion
25*d*: large-diameter hole portion
27*d*: bottom surface of large-diameter hole portion
28*d*: depression formed by protrusion
120*d*: deep hole forming punch
124*d*: annular inclined surface located toward outer circumference of forward end surface of deep hole forming punch
125*d*: protrusion
120*e*: punch for punching
D1: outside diameter of protrusion
D2: inside diameter of small-diameter hole portion

What is claimed is:

1. A method for manufacturing, by cold forging, a multi-diameter tubular body having a forward end and an axially extending through hole, the multi-diameter tubular body including a small-diameter hole portion having a small inside diameter and a large-diameter hole portion having a relatively large inside diameter, which are coaxially arranged rearward from the forward end of the multi-diameter tubular body, the multi-diameter tubular body further having a rearward-facing annular ledge surface tapering forward and located at a boundary between the small-diameter hole portion and the large-diameter hole portion, the method comprising:

providing a columnar starting material having a rear end surface;

subjecting the starting material to one or a plurality of forming steps to form a preliminary hole for the large-diameter hole portion in the rear end surface of the columnar starting material;

thrusting a deep hole forming punch into the preliminary hole, the deep hole forming punch having a forward end surface and an annular inclined surface which is located in a region of the forward end surface extending along an outer circumference of the forward end surface and which is inclined toward a center, the deep hole forming punch further having a protrusion which is located coaxially at the center of the forward end surface and inward of the annular inclined surface, the protrusion protruding forward and having a predetermined outside diameter, the annular inclined surface of the deep hole forming punch forming an annular surface which is to become the rearward-facing annular ledge surface, and the protrusion of the deep hole forming punch forming a depression inward of the annular surface; and driving a punch for punching into a bottom surface of the large-diameter hole portion so as to punch out the bottom surface of the large-diameter hole portion forming the small-diameter hole portion and leaving the rearward-facing annular ledge surface, the method being characterized in that the outside diameter of the protrusion of the deep hole forming punch is smaller than the inside diameter of the small-diameter hole portion.

2. The method for manufacturing a multi-diameter tubular body by cold forging according to claim 1, wherein, when the punch for punching is driven, an outer circumferential surface of the punch for punching is guided by an inner circumferential surface of the large-diameter hole portion formed through deep hole forming by the deep hole forming punch.

3. The method for manufacturing a multi-diameter tubular body by cold forging according to claim 1, wherein the punch for punching has a communication hole extending therethrough for establishing communication between a forward end surface thereof and a rear region thereof so as to prevent the forward end surface of the punch from closing the depression formed by the protrusion.

4. The method for manufacturing a multi-diameter tubular body by cold forging according to claim 2, wherein the punch for punching has a communication hole extending therethrough for establishing communication between a forward end surface thereof and a rear region thereof so as to prevent the forward end surface of the punch from closing the depression formed by the protrusion.

* * * * *